United States Patent [19]

Tack et al.

[11] 4,261,703

[45] Apr. 14, 1981

[54] ADDITIVE COMBINATIONS AND FUELS CONTAINING THEM

[75] Inventors: Robert D. Tack, Abingdon; Kenneth Lewtas, Wantage, both of United Kingdom

[73] Assignee: Exxon Research & Engineering Co., Florham Park, N.J.

[21] Appl. No.: 41,768

[22] Filed: May 23, 1979

[30] Foreign Application Priority Data

May 25, 1978 [GB] United Kingdom ..... 22345/78

[51] Int. Cl.[3] ..... C10L 1/26

[52] U.S. Cl. ..... 44/62; 44/70

[58] Field of Search ..... 44/62, 70

[56] References Cited

U.S. PATENT DOCUMENTS

| | | | |
|---|---|---|---|
| 3,658,493 | 4/1972 | Hollyday, Jr. | 44/62 |
| 3,762,888 | 10/1973 | Kober et al. | 44/62 |
| 3,846,093 | 11/1974 | Feldman | 44/62 |
| 3,961,916 | 6/1976 | Ilnyckyj et al. | 44/62 |
| 3,982,909 | 9/1976 | Hollyday, Jr. | 44/71 |
| 4,140,492 | 2/1979 | Feldman et al. | 44/62 |
| 4,182,613 | 1/1980 | Stover et al. | 44/51 |
| 4,211,534 | 9/1980 | Feldman | 44/62 |

FOREIGN PATENT DOCUMENTS 1469016 3/1977 United Kingdom .

*Primary Examiner*—Patrick Garvin
*Assistant Examiner*—Y. Harris-Smith
*Attorney, Agent, or Firm*—Frank T. Johman

[57] ABSTRACT

Three component additive combinations for improving the flow of distillate fuel oils comprise (A) a conventional distillate fuel flow improver (B) a lube oil pour depressant and (C) a polar compound other than certain specified nitrogen compounds which acts as an anti-agglomerant for wax particles in the fuel oil.

22 Claims, No Drawings

ADDITIVE COMBINATIONS AND FUELS CONTAINING THEM

Two component additive systems for treating distillate fuel oil to limit the size of wax crystals that form in the fuel oil in cold weather are known, as shown by the following patents.

U.K. Pat. No. 1,469,016 teaches ethylene polymers or copolymers which are pour depressants for distillate fuels, in combination with a second polymer having alkyl groups of 6 to 18 carbon atoms, which is a polymer of an olefin or unsaturated dicarboxylic acid ester, useful in improving the cold flow properties of distillate fuel oils.

U.S. Pat. No. 3,982,909 teaches nitrogen compounds such as amides, diamides, ammonium salts or monoesters of dicarboxylic acids, alone or in combination with a hydrocarbon microcrystalline wax and/or a pour point depressant, particularly an ethylene backbone polymeric pour point depressant, are wax crystal modifiers and cold flow improvers for middle distillate fuel oils, particularly diesel fuel.

U.S. Pat. Nos. 3,444,082 and 3,846,093 teach various amides and salts of alkenyl succinic anhydride reacted with amines, in combination with ethylene copolymer pour point depressants, for distillate fuels.

The distillate fuel oil, to which flow improvers may be added, is stored in various size tanks at refineries, at marketing depots or at final distribution terminals. Due to the large volume of the oil in such tanks, the bulk oil temperature drops slowly, even though the ambient temperature may be considerably below the cloud point (the temperature at which the wax begins to crystallize out and becomes visible, i.e., the oil becomes cloudy).

If the winter is particularly cold and prolonged so that bulk oil is stored for a long time during very cold weather, the bulk oil may eventually drop below its cloud point. These conditions may then result in crystallized wax settling to the bottom of the tank and in addition a bottom layer of oil forms which has an enriched wax content and a cloud point considerably higher than that of the fuel originally pumped into the tank whilst the upper layers of the oil are partially dewaxed and have relatively low cloud points. The crystal rich bottom layer of oil will therefore exhibit a greater tendency towards wax agglomeration than the upper layers and such wax agglomeration frequently leads to the plugging of screens and other flow constrictions in oil distribution systems. Since the outlets from the tanks are near their bottom, if oil is drawn off which has an abnormally high amount of wax in the form of relatively large crystallites due to said crystal agglomeration, although the agglomerates may pass through the filters on the tank, they may block protective screens or filters on the truck or clog filters or small diameter fuel lines in the customer's storage system.

We have found that these problems may be reduced by using a three (or more) component additive combination for distillate fuel oils, comprising (A) a distillate flow improving composition (B) a lube oil pour depressant and (C) a polar oil soluble compound different from (A) and (B) and of formula RX, where R is an oil solubilizing hydrocarbon group and X is a polar group said compound acting as an anti-agglomerant for wax particles in the fuel oil. We have found this combination to be particularly useful in distillate fuel oils boiling in the range of 120° C. to 500° C., especially 160° C. to 400° C., for controlling the size of wax crystals that form at low temperatures.

In general, a three component additive combination of the invention has been found effective in not only keeping the initially formed wax crystals small, but also in inhibiting the agglomeration of the wax particles that are formed. In addition, the additives slow the settling of the wax crystals under gravity.

In a preferred form, the present invention provides a fuel composition which comprises distillate fuel oil and from 0.001 to 0.5 wt. %, preferably 0.01 to 0.2 wt%, most preferably 0.05 to 0.1 wt. % of a flow and filterability improving, multicomponent additive composition comprising: (A) one part by weight of a distillate flow improver composition (B) 0.1 to 10, preferably 0.5 to 5 most preferably 1 to 2 parts by weight of a lube oil pour depressant (C) 0.1 to 10, preferably 0.5 to 5 most preferably 1 to 2, parts by weight of a polar oil soluble compound of formula RX as hereinbefore defined which acts as an anti-agglomerant for the wax particles.

For case of handling the additives will generally be supplied as concentrates containing 30 to 80 wt. %, a hydrocarbon diluent with 70 to 20 wt. % of the additive mixture of (A), (B) and (C), dissolved therein. The present invention is also concerned with such concentrates.

The distillate flow improver (A) used in the additive combinations in the present invention is a wax crystal growth arrestor and may also contain a nucleator for the wax crystals. They are preferably ethylene polymers of the type known in the art as wax crystal modifiers, e.g. pour depressants and cold flow improvers for distillate fuel oils. These polymers will have a polymethylene backbone which is divided into segments by hydrocarbon or oxy-hydrocarbon side chains, by alicyclic or heterocyclic structures or by chlorine atoms. They may be homopolymers of ethylene as prepared by free radical polymerization so as to result in some branching. More usually, they will comprise copolymers of above 3 to 40, preferably 4 to 20, molar proportions of ethylene per molar proportion of a second ethylenically unsaturated monomer which can be a single monomer or a mixture of monomers in any proportion. The polymers will generally have a number average molecular weight in the range of about 500 to 50,000 preferably about 800 to about 20,000, e.g., 1000 to 6000, as measured by Vapor Pressure Osmometry (VPO), for example by using a Mechrolab Vapor Pressure Osmometer Model 302B.

The unsaturated monomers, copolymerizable with ethylene, include unsaturated mono and diesters of the general formula:

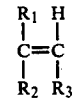

wherein $R_1$ is hydrogen or methyl; $R_2$ is a —$OOCR_4$ group wherein $R_4$ is hydrogen or a $C_1$ to $C_{28}$, more usually $C_1$ to $C_{16}$, and preferably a $C_1$ to $C_8$, straight or branched chain alkyl group; or $R_2$ is a —$COOR_4$ group wherein $R_4$ is as previously described and $R_3$ is hydrogen or —$COOR_4$ as previously defined. The monomer, when $R_1$ and $R_3$ are hydrogen and $R_2$ is —$OOCR_4$, includes vinyl alcohol esters of $C_1$ to $C_{29}$, more usually $C_1$ to $C_{17}$, monocarboxylic acid, and preferably $C_2$ to $C_5$ monocarboxylic acid. Examples of such esters include vinyl acetate, vinyl isobutyrate, vinyl laurate, vinyl myristate and vinyl palmitate, vinyl acetate being the preferred ester. When $R_2$ is —$COOR_4$ and $R_3$ is hydrogen, such esters include methyl acrylate, isobutyl acrylate, methyl methacrylate, lauryl acrylate, $C_{13}$ Oxo alcohol esters of methacrylic acid, etc. Examples of monomers where $R_1$ is hydrogen and either or both $R_2$ and $R_3$ are —$COOR_4$ groups, include mono and diesters of unsaturated dicarboxylic acids such as: mono $C_{13}$ Oxo fumarate, di-$C_{13}$ Oxo fumarate, di-isopropyl maleate, di-lauryl fumarate and ethyl methyl fumarate.

Another class of monomers that can be copolymerized with ethylene include $C_3$ to $C_{16}$ alpha monoolefins, which can be either branched or unbranched, such as propylene, isobutene, n-octene-1, isooctene-1, n-decene-1, dodecene-1, etc.

Still other monomers include vinyl chloride, although essentially the same result can be obtained by chlorinating polyethylene, e.g., to a chlorine content of about 10 to 35 wt. %.

Also included among the distillate flow improvers are the hydrogenated polybutadiene flow improvers, having mainly 1,4 addition with some 1,2 addition such as those of U.S. Pat. No. 3,600,311.

The preferred ethylene copolymers are ethylene vinyl ester especially vinyl acetate copolymers. These may be prepared by high pressure, non solvent processes or by our preferred prosess in which solvent, and 5–50 wt. % of the total amount of monomer charge other than ethylene are charged to a stainless steel pressure vessel which is equipped with a stirrer and a heat exchanger. The temperature of the pressure vessel is then brought to the desired reaction temperature, e.g., 70° to 200° C. by passing steam through the heat exchanger and pressurised to the desired pressure with ethylene, e.g., 700 to 25,000 psig, usually 900 to 7,000 psig. The initiator, usually as a concentrate in a solvent (usually the same solvent as used in the reaction) so that it can be pumped, and additional amounts of the monomer charge other than ethylene, e.g. the vinyl ester, can be added to the vessel continuously, or at least periodically, during the reaction time. Also during this reaction time, as ethylene is consumed in the polymerization reaction, additional ethylene is supplied through a pressure controlling regulator so as to maintain the desired reaction pressure fairly constant at all times, the reactor temperature is held substantially constant by means of the heat exchanger. Following the completion of the reaction, usually a total reaction time of ¼ to 10 hours will suffice, the liquid phase is discharged from the reactor and solvent and other volatile constituents of the reaction mixture are stripped off leaving the copolymer as residue. To facilitate handling and blending, the polymer is generally dissolved in a mineral oil, preferably an aromatic solvent, such as heavy aromatic naphtha, to form a concentrate usually containing 10 to 60 wt. % of copolymer.

Usually about 50 to 1200, preferably 100 to 600 parts by weight solvent based upon 100 parts by weight of copolymer to be produced will be used. A hydrocarbon solvent such as benzene, hexane, cyclohexane, t-butyl alcohol, etc., and about 0.1 to 5 parts by weight of initiator will generally be used.

The initiator is chosen from a class of compounds which at elevated temperatures undergo a breakdown yielding radicals, such as peroxide or azo type initiators, including the acyl peroxides of $C_2$ to $C_{18}$ branched or unbranched carboxylic acids, as well as other common initiators. Specific examples of such initiators include dibenzoyl peroxide, ditertiary butyl peroxide, t-butyl perbenzoate, t-butyl peroctanoate, t-butyl hydroperoxide, alpha, alpha', azo-diisobutyronitrile, dilauroyl peroxide, etc. The choice of the peroxide is governed primarily by the polymerisation conditions to be used, the desired polymer structure and the efficiency of the initiator. t-butyl peroctanoate, di-lauroyl peroxide and di-t-butyl peroxide are preferred initiators.

Mixtures of ethylene copolymers can also be used. Thus, U.S. Pat. No. 3,961,916 teaches that improved results can be obtained using an ethylene copolymer mixture containing components with different solubilities one of which serves primarily as a nucleator to seed the growth of wax crystals, while the other more soluble ethylene component serves as a wax crystal growth arrestor to inhibit the growth of the wax crystals after they are formed. Such a combination of nucleator and wax growth arrestor is the preferred distillate flow improver of the compositions of the present invention.

The lube oil pour point depressant is preferably an oil soluble ester and/or higher olefin polymer and will generally have a number average molecular weight in the range of about 1000 to 200,000, e.g. 1,000 to 100,000, preferably 1000 to 50,000, as measured, for example, by Vapor Pressure Osmometry such as by a Mechrolab Vapor Pressure Osmometer, or by Gel Permeation Chromatography. These second polymers include (a) polymers, both homopolymers and copolymers of unsaturated alkyl ester, including copolymers with other unsaturated monomers, e.g. olefins other than ethylene, nitrogen containing monomers, etc. and (b) homopolymers and copolymers of olefins, other than ethylene.

In our preferred lube oil pour depressant at least 10 wt. %, preferably at least 25 wt. % and frequently 50 wt. % or more of the polymer will be in the form of straight chain $C_6$ to $C_{30}$, e.g., $C_8$ to $C_{24}$, e.g., $C_8$ to $C_{16}$ alkyl groups, usually of an alpha olefine or an ester, for example, the alkyl portion of an alcohol used to esterify a mono or dicarboxylic acid, or anhydride. To illustrate, using a $C_{16}$ straight chain alkyl acrylate as the source of the aforesaid straight chain alkyl group, one could have a homopolymer or a copolymer of said n-hexadecyl acrylate with a short chain monomer, e.g. a copolymer of n-hexadecyl acrylate with methyl acrylate. Or one could have n-hexadecyl acrylate copolymerized with docosanyl acrylate. Or, one could have a terpolymer of methyl acrylate, n-hexadecyl acrylate, and $c_{30}$ branched chain alkyl acrylate, alternatively the n-hexadecyl acrylate could be copolymerised with an unsaturated ester other than one derived from acrylic acid such an ester having its unsaturation in either the acid or the alcohol part.

Among the esters which can be used to make these lube oil pour depressants, including homopolymers and copolymers of two or more monomers, are ethylenically unsaturated, mono- and diesters represented by the formula:

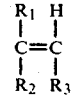

wherein $R_1$ is hydrogen or $C_1$ to $C_6$ hydrocarbyl, preferably alkyl, group, e.g. methyl; $R_2$ is a —$OOCR_4$ or —$COOR_4$ group wherein $R_4$ is hydrogen or a $C_1$ to $C_{30}$, e.g. $C_1$ to $C_{24}$ straight or branched chain hydrocarbyl, e.g. alkyl group; and $R_3$ is hydrogen or —$COOR_4$, at least one of $R_1$, $R_2$, $R_3$ and $R_4$ containing a straight chain $C_6$ to $C_{30}$, preferably a $C_8$–$C_{24}$, most preferably a $C_8$–$C_{16}$ alkyl group. The monomer, when $R_1$ and $R_3$ are hydrogens and $R_2$ is —$OOCR_4$ includes vinyl alcohol esters of monocarboxylic acids. Examples of such esters include vinyl laurate, vinyl myristate, vinyl palmitate, vinyl behenate, vinyl tricosanoate, etc. Examples of esters in which $R_2$ is —$COOR_4$, include lauryl acrylate, $C_{13}$ Oxo alcohol esters of methacrylic acid, behenyl acrylate, behenyl methacrylate, tricosanyl acrylate, etc. Examples of monomers where $R_1$ is hydrogen and $R_2$ and $R_3$ are both —$COOR_4$ groups, include: mono and diesters of unsaturated dicarboxylic acids such as mono $C_{13}$ Oxo fumarate, di $C_{13}$ Oxo maleate, dieicosyl fumarate, laurylhexyl fumarate, didocosyl fumarate, dieicosyl maleate, didocosyl citraconate, monodocosyl maleate, dieicosyl citraconate, (di(tricosyl) fumarate, dipentacosyl citraconate. Short chain alkyl esters such as vinyl acetate, vinyl propionate, methyl acrylate, methyl methacrylate, isobutyl acrylate, mono-isopropyl maleate and isopropyl fumarate may be used in copolymers with the longer chain alkyl esters.

In addition, minor molar amounts, e.g. 0 to 20 mole %, e.g. 0.1 to 10 mole %, nitrogen-containing monomers can be copolymerized into the polymer, along with the foregoing monomers. These nitrogen containing monomers include those represented by the formula:

$$R—CH=C—H_2$$

R is a 5- or 6-membered heterocyclic nitrogen-containing ring which may contain one or more substituent hydrocarbon groups in addition to the vinyl group. In the above formula, the vinyl radical can be attached to the nitrogen or to a carbon atom in the radical R. Examples of such vinyl derivatives include 2-vinylpyridine, 4-vinylpyridine, 2-methyl-2-vinylpyridine, 2-ethyl-5-vinylpyridine, 4-methyl-5-vinylpyridine, N-vinylpyrrolidone and 4-vinyl-pyrrolidone.

Other monomers that can be included are the unsaturated amides such as those of the formula:

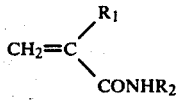

wherein $R_1$ is hydrogen or methyl, and $R_2$ is hydrogen, an alkyl or alkoxy radical, generally having up to about 24 carbon atoms. Such amides are obtained by reacting acrylic acid or a low molecular weight acrylic ester with an amine such as butylamine, hexylamine, tetrapropylene amine, cetylamine, ethanolamine and tertiaryalkyl primary amines.

As an alternative embodiment of this invention some of the lube oil pour depressant may contain polar functions which have an anti-agglomerating effect on the wax and thus be component C of the additive combination of this invention. Preferred examples are compounds containing esters of the type described above in which $R_4$ is an alkoxy amine.

Preferred ester polymers for the present purpose, from the point of view of availability and cost, are copolymers of vinyl acetate and a dialkyl fumarate in about equimolar proportions, and polymers or copolymers of acrylic esters or methacrylic esters. The alcohols used to prepare the fumarate and said acrylic and methacrylic ester are usually monohydric, saturated, straight chain primary aliphatic alcohols containing from 4 to 30 carbon atoms. These esters need not be pure, but may be prepared from technical grade mixtures.

Any mixtures of two or more polymers of the esters set forth herein can be used. These may be simple mixtures of such polymer, or they may be copolymers which can be prepared by polymerizing a mixture of two or more of the monomeric esters. Mixed esters derived by the reaction of single or mixed acids with a mixture of alcohols may also be used.

The ester polymers are generally prepared by polymerizing a solution of the ester in a hydrocarbon solvent such as heptane, benzene, cyclohexane, or white oil, at a temperature from 60° C. to 250° C. under a blanket of refluxing solvent or an inert gas such as nitrogen or carbon dioxide to exclude oxygen. The polymerisation is preferably promoted with a peroxide or azo free radical initiator, benzoyl peroxide being preferred.

The unsaturated carboxylic acid ester can be copolymerized with an olefin. If a dicarboxylic acid anhydride is used, e.g. maleic anhydride, it can be polymerized with the olefin, and then esterified with alcohol. To further illustrate, the ethylenically unsaturated carboxylic acid or derivative thereof is reacted with an alpha-olefin, such as $C_8$–$C_{32}$, preferably a $C_{10}$–$C_{26}$, most preferably a $C_{10}$–$C_{18}$ olefin, by mixing the olefin and acid, e.g., maleic anhydride, usually in about equimolar amounts, and heating to a temperature of at least 80° C., preferably at least 125° C., in the presence of a free radical polymerization promoter such as benzoyl peroxide or t-butyl hydroperoxide or di-t-butyl peroxide. Other examples of copolymers are those of maleic anhydride with styrene, or cracked wax olefins, which copolymers are then usually completely esterified with alcohol, as are the other aforesaid specific examples of the olefin ester polymers.

Alternatively the lube oil pour depressant used in the compositions of our invention may be olefin polymers, which can be either homopolymers and copolymers of long chain $C_8$ to $C_{32}$, preferably $C_{10}$ to $C_{26}$, most preferably $C_{10}$–$C_{18}$ aliphatic alpha-monoolefins, or copolymers of said long chain alpha-monoolefins with shorter $C_3$–$C_7$ aliphatic alpha-olefins, or with styrene or its derivatives, e.g., copolymers comprising 20 to 90 wt. % of said $C_8$ to $C_{32}$ alpha-olefin and 80 to 10 wt. % of said $C_3$ to $C_7$ aliphatic monoolefin or styrene-type olefin.

These olefin polymers may be conveniently prepared by polymerizing the monomers under relatively mild conditions of temperature and pressure in the presence of a Friedel-Crafts type catalyst, e.g. $AlCl_3$, which will give an irregular polymer, or Ziegler-Natta type of an organo-metallic catalyst, i.e., a mixture of a compound derived from a Group IV, V or VI metal of the Periodic Table in combination with an organometallic compound of a Group I, II or III metal of the Periodic Table, wherein the amount of the compound derived from a Group IV–VI metal may range from 0.01 to 2.0 moles per mole of the organo-metallic compound.

Examples of the Ziegler-Natta type catalysts include the following combinations: aluminum triisobutyl, aluminum chloride, and vanadium trichloride; vanadium tetrachloride and aluminum trihexyl; vanadium trichloride and aluminum trihexyl; vanadium triacetyl-acetonate and aluminum diethyl chloride; titanium tetrachloide and aluminum trihexyl; vanadium trichloride and aluminum trihexyl; titanium trichloride and aluminium trihexyl; titanium dichloride and aluminum trihexyl, etc.

The polymerization is usually carried out by mixing the catalyst components in an inert diluent such as a hydrocarbon solvent, e.g, hexane, benzene, toluene, xylene, heptane, etc., and then adding the monomers into the catalyst mixture at atmospheric or superatmospheric pressures and temperatures within the range between about 50° and 180° F. Usually atmospheric pressure is employed when polymerizing monomers containing more than 4 carbon atoms in the molecule and elevated pressures are used if the more volatile $C_3$ or $C_4$ alpha-olefins are present. The time of reaction will depend upon, and is interrelated to, the temperature of the reaction, the choice of catalyst, and the pressure employed. In general, however, ½ to 5 hours will complete the reaction.

The polar compound, which is component (C), is different from the distillate flow improver and the lube oil pour depressant, and is generally monomeric and may be ionic or non-ionic. The compound which inhibits agglomeration of wax particles in the oil should not be an oil soluble nitrogen compound containing about 30 to 300 carbon atoms and having at least one straight chain alkyl segment of 8 to 40 carbons and selected from the class consisting of amine salts and/or amides of hydrocarbyl carboxylic acids or anhydrides having 1 to 4 carboxyl groups. Examples of suitable ionic compounds are those in which the anion is the oil soluble group $R_5Y$ Where Y is the polar end group and $R_5$ is an oil solubilising group which may be one or more substituted or unsubstituted, unsaturated or saturated hydrocarbon groups which may be aliphatic, cycloaliphatic or aromatic, $R_5$ is preferably alkyl, alkaryl or alkenyl. $R_5$ should preferably contain a total of from 8 to 150 carbon atoms. Where the compound is non-ionic we prefer that $R_5$ contain from 8 to 30, more preferably 12 to 24, most preferably 12 to 18 carbon atoms. Where the compound is ionic we prefer that it contains from 8 to 150 carbon atoms, preferably 50 to 120 carbon atoms most preferably 70 to 100 carbon atoms and we particularly prefer that these be derived from alkyl groups containing from 1 to 30, preferably 12 to 30 carbon atoms. It is preferred that when $R_5$ is composed of alkyl groups that they be straight chain. Alternatively $R_5$ may be an alkoxylated chain.

Examples of suitable polar end groups Y include the sulphonate $SO^-_3$ group, the sulphate $OSO^-_3$ group, the phosphate, $PO^-_2$ group, the phenate $PhO^-$ group and the borate $BO^-$ group. Thus our preferred anions include $R_5SO^-_3$, $R_5OSO^-_3$; $(R_5O)_2\ PO^-_2$; $R_5PHO$— and $(R_5O)_2BO$ with $R_5$ being the oil solubilizing hydrocarbon group.

Where the anion is a sulphonate, we prefer to use an alkaryl sulphonate which may be any of the well known neutral or basic sulphonates.

Where the anion is phenate, we prefer it be derived from alkyl phenol, or bridged phenols, including those of the general formula

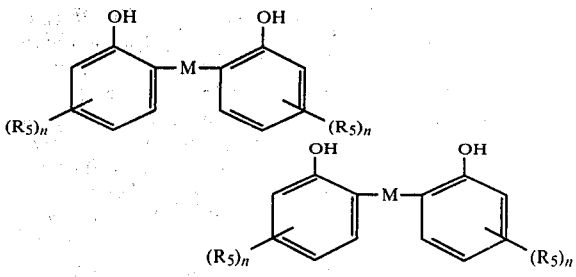

where M is a linking group of one or more, e.g. 1 to 4, carbon or sulphur atoms, and $R_5$ is as defined above. Here again, the phenate used may be any of the well known neutral or basic compounds.

When the anion is borate, sulphate or phosphate, $R_5$ may altenatively be alkoxylated chains. Examples of such compounds in the case of sulphates include the $(R_6—(OCH_2CH_2)—O)^-$ group and in the case of phosphates and borates the $(R_6—(OCH_2CH_2)_n—O)^-_2$ group, wherein $R_6$ is as defined above.

The cation for these salts is preferably a mono-, di-, tri or tetra alkyl ammonium or phosphonium ion of formula $R_7ZH^+_3$; $(R_7)_2ZH^+_2$; $(R_7)_3ZH^+$; $(R_7)_4Z^+$ where $R_7$ is hydrocarbyl, preferably alkyl. When the cation contains more than one such group they may be the same or different, and Z is nitrogen or phosphorus. $R_7$ preferably has a carbon content within the definition given above for $R_5$.

Examples of suitable alkyl groups include methyl, ethyl, propyl, n-octyl, n-dodecyl, n-tridecyl, $C_{13}$ Oxo, coco, tallow behenyl, lauryl, dodecyl-octyl, coco-methyl, tallow-methyl, methyl-n-octyl, methyl-n-dodecyl, methyl-behenyl, tallow.

The group $R_7$ may be substituted by, for example, hydroxy or amino groups (as for example in the polyamine). As an alternative embodiment the hydrocarbyl group of the cation can provide the oil-solubility, as for example in the salts of fatty amines such as tallow amine.

Alkyl substituted dicarboxylic acids or their anhydrides or the derivatives thereof may also be used as the polar compound. For example, succinic acid derivatives of the general formula

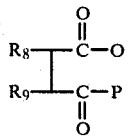

where at least one of $R_8$ or $R_9$ is a long chain (e.g. 30 to 150) carbon atoms alkyl group preferably polyisobutylene or polypropylene. The other of $R_8$ or $R_9$ may be similar or be hydrogen. P and O may be the same or different, they may be carboxylic acid groups, esters or may together form an anhydride ring.

As a less preferred alternative the cation may be metallic and if so the metal is preferably an alkali metal such as sodium or potassium or an alkaline earth metal such as barium, calcium or magnesium.

Whilst the ionic type compounds described above are our preferred polar oil soluble compounds we have found that polar, non-ionic compounds are also effective. For example primary amines of formula $R_{10}NH_2$, secondary amines $R_{10}NH_2$ and primary alcohols $R_{10}$-OH may be used providing they are oil soluble and for this reason $R_{10}$ preferably contain at least 8 carbon atoms and preferably has the carbon content specified above for $R_5$ in the case of non-ionic compounds.

We have found that although these polar compounds have little effect on wax formation or crystal growth, when they are the sole additive in a fuel they significantly reduce the extent to which already formed wax crystals agglomerate. A less important effect of these compounds is that many of them reduce the rate at which wax settles from fuels containing nucleating and/or growth arresting additives. We find that the presence of these polar compounds is effective in common fuel storage conditions, even when fuel is stored for an extended period at low temperatures and when its temperature is reduced very slowly (i.e. around 0.3° C./hour.

The distillate fuel oils in which the additive combinations of the present invention are especially useful generally boil within the range of 120° C. to 500° C., e.g. 150° to 400° C. The fuel oil can comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels and heating oils. The heating oil may be either a straight run distillate or a cracked gas oil or a combination of the two. The low temperature flow problem alleviated by using the additive combinations of the present invention is most usually encountered with diesel fuels and with heating oils.

There has been a tendency recently to increase the final boiling point (FBP) of distillates so as to maximise the yield of fuels. These fuels however include longer chain paraffins in the fuel and therefore generally have higher cloud points. This in turn aggravates the difficulties encountered in handling these fuels in cold weather and increases the need to include flow improving additives.

In measuring the boiling characteristics of these high end point fuels, ASTM-1160 distillation (a distillation under vacuum) can be used and the resulting boiling points are then corrected to boiling points at atmospheric pressure. Alternatively, ASTM Method D-86, which is an atmospheric distillation can be used, but usually some thermal cracking will occur so that the results of the D-86 distillation are less accurate.

Oil soluble, as used herein, means that the additive is soluble in the fuel at ambient temperatures, e.g. at least to the extent of 0.1 wt.% additive in the fuel oil at 25° C., although at least some of the additive comes out of solution near the cloud point in order to modify the wax crystals that form.

The invention is illustrated but in no way limited by reference to the following Examples.

In these Examples, the distillate flow improver A used was a concentrate in an aromatic diluent of about 50 wt.% of a mixture of two ethylene-vinyl acetate copolymers, having different oil solubilities, so that one functions primarily as a wax growth arrestor and the other as a nucleator, in accord with the teachings of U.S. Pat. No. 3,961,916. More specifically, the polymer is a polymer mixture of about 75 wt.% of wax growth arrestor and about 25 wt.% of nucleator. The wax growth arrestor consists of ethylene and about 38 wt.% vinyl acetate, and has a molecular weight of about 1800 (VPO). It is identified in said U.S. Pat. No. 3,961,916 as Copolymer B of Example 1 (column 8, lines 25–35). The nucleator consists of ethylene and about 16 wt.% vinyl acetate and has a molecular weight of about 3000 (VPO). It is identified in said U.S. Pat. No. 3,961,916 as Copolymer H (See Table I, columns 7–8).

The lube oil pour depressant B was an oil concentrate of about 50 wt.% of mineral lubricating oil and about 50 wt.% of a copolymer of dialkyl fumarate and vinyl acetate in about equimolar proportions, having a number average molecular weight (VPO) of about 15,000 prepared in conventional manner using a peroxide initiator and solvent. The fumarate was prepared by esterifying fumaric acid with a mixture of straight chain alcohols averaging about $C_{12}$. A typical analysis of the alcohol mixture is as follows: 0.7 wt.% $C_6$, 10 wt.% $C_8$, 7 wt.% $C_{10}$, 47 wt.% $C_{12}$, 17 wt.% $C_{14}$, 8 wt.% $C_{16}$, 10 wt.% $C_{18}$.

The fuels in which the Additives were tested are described in the following table:

| Fuel | 1 | 2 | 3 | 4 |
|---|---|---|---|---|
| Cloud Point, °C. (as measured by ASTM D-3117) | +2.0 | +3.0 | +2.0 | 0.0 |
| Wax Appearance Point, °C. (See ASTM D-3117) | −2.5 | −4.4 | −2.0 | −3.3 |
| Distillation, °C. (ASTM-D-1160) | | | | |
| Initial Boiling Point °C. | 184 | 185 | 162 | 179 |
| 20% Boiling Point | 249 | 230 | 203 | 224 |
| 90% Boiling Point | 351 | 345 | 337 | 340 |
| Final Boiling Point | 383 | 376 | 340 | 377 |

The following Polar compounds (C) were used in the examples:

1. $C_{24}H_{49}Ph\ SO_4^-\ \overset{+}{N}R_4$
2. $C_{24}H_{49}Ph\ SO_4^-\ \overset{+}{N}H_2(C_{12}H_{25})_2$
3. $C_9H_{19}PhO^-\ \overset{+}{N}H_2$
4. $C_{17}H_{35}CO_2^-\ \overset{+}{N}H_2$
5. $CH_3(CH_2)_{15-17}NH_2$
6. $(CH_3(CH_2)_{15-17})_2NH$
7. $C_{18}H_{37}OH$
8. $C_{14}H_{29}OH$ In each instance the hydrocarbyl groups were straight chain.

The polymeric additives A and B were added in the form of the aforesaid oil concentrates while the polar compound was added to the oil directly.

The initial response of the oils to the additives was measured by the Cold Filter Plugging Point Test (CFPPT) which is carried out by the procedure described in detail in "Journal of the Institute of Petroleum", Volume 52, Number 510, June 1966 pp. 173–185. In brief, a 40 ml. sample of the oil to be tested is cooled in a bath to about −34° C. Periodically (at each one degree Centigrade drop in temperature starting from at least 2° C. above the cloud point) the cooled oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area of about 12 millimeter diameter. The periodic tests are each initiated by applying a vacuum to the upper end of the pipette whereby oil is drawn through the screen up into the pipette to a mark indicating 20 ml. of oil. The test is repeated with each one degree drop in temperature until the oil fails to fill the pipette within 60 seconds. The results of the test are reported as the temperature (the plugging point) in °C. at which the oils fail to fill the pipette in 1 minute.

The behaviour of the oils at sustained low temperatures was assessed by subjecting the oils to a cold soak test in which separate 500 ml samples of each test blend in an addition glass funnel were first cooled at 1° C. and 0.3° C. per hour from room temperature of about 20° C. to −8° C. The test blend was thereafter held at −8° C. for the indicated period. A 50 ml portion of this cooled test fuel blend was drawn off from the bottom of the funnel and transferred to another container and subjected to a modified Cold Filter Plugging Point Test (CFPPT). In this test a sample at the cold soak temperature is sucked by 200 mm water vacuum pressure through a filter screen and the minimum mesh through which it would pass measured. The portion was then allowed to return to room temperature (about 20° C.) after which it was subjected to the ASTM cloud point determination.

EXAMPLE 1

Visual wax settling of Fuel 1 treated with the ethylene backbone copolymer, the lube oil pour depressant and certain of the polar compounds (2) was observed and the following table shows the advantage of the three component mixtures in inhibiting wax settling.

| Additive concentration (ppm) | | | | Waxy Layer (Vol %) | | |
|---|---|---|---|---|---|---|
| | | | | 25 hrs soak | 37 hrs soak | 61 hrs soak |
| A | B | C | (No.) | at −8° C. | at −8° C. | at −8° C. |
| 100 | — | — | | 15 | 15 | 14 |
| 300 | — | — | | 15 | 15 | 13 |
| 500 | — | — | | 15 | 13 | 12 |
| 100 | 100 | 50 | of (1) | 88 | 86 | 77 |
| 100 | 100 | 50 | of (2) | 87 | 86 | 79 |
| 100 | 100 | 50 | of (3) | 89 | 86 | 79 |
| 100 | 100 | 50 | of (4) | 89 | 88 | 85 |
| 100 | 100 | 50 | of (5) | 89 | 87 | 83 |
| 100 | 100 | 50 | of (6) | 91 | 89 | 87 |
| 100 | 100 | 50 | of (7) | 88 | 89 | 86 |

EXAMPLE 2

Wax settling is quantitatively determined by the wax enrichment of the bottom layers of the cold soaked fuel. The greater the correlation of the wax appearance points (WAP) of the top and bottom 10% with the WAP of the original fuel the less wax settling has occurred. The following table shows the reduced wax settling when the three-component mixture is used in Fuel 2.

| Additive conc. (ppm) | | | Wax Appearance Point °C. | |
|---|---|---|---|---|
| A | B | C No (3) | Top 10% | Bottom 10% |
| — | — | — | − 4.4 | −4.4 |
| 300 | — | — | −11.0 | +5.5 |
| 400 | — | — | −11.5 | +5.0 |
| 600 | — | — | −12.0 | +4.0 |
| 200 | 200 | 100 | − 4.5 | −4.4 |

In this test the fuel is cooled at 0.3° C./hr down to −8° C. and held at this temperature for 70 hours.

EXAMPLE 3

The polar compounds (C) were tested on their own in Fuel 3 using the standard CFPP test. The results show that these compounds do not possess, on their own, any significant wax crystal modifying properties. The results for the tests using the conventional flow improver (A) are added for comparison.

| Additive | Concentration (ppm) | CFPP (°C.) |
|---|---|---|
| None | — | −2 |
| C1 | 100 | −3 |
| C1 | 300 | −3 |
| C2 | 100 | −4 |
| C2 | 300 | −3 |
| C3 | 100 | −3 |
| C3 | 300 | −3 |
| A | 100 | −11 |
| A | 300 | −15 |

EXAMPLE 4

Samples of Fuel 4 treated with certain quantities of the distillate flow improver (A), the lube oil pour depressant (B), and the polar compound (C) were cooled down to 5 degrees below its wax appearance point at 0.3° C./hr and held at this temperature for 35 hours. The following table shows the advantage of the three-component mixture over the conventional flow improver (A) in preventing wax settling and giving improved filterability as shown the modified CFPP test.

| Additive conc. (ppm) | | | | Waxy Layer | WAP of Bottom | Minimum Mesh |
|---|---|---|---|---|---|---|
| A | B | C | (No.) | (Vol %) | 10% (°C.) | Passed |
| — | — | — | | — | −3.0 | |
| 100 | — | — | | 10 | −10.0 | 100 |
| 200 | — | — | | 10 | — | 100 |
| 400 | — | — | | 10 | — | 150 |
| 100 | 200 | 100 | (3) | 100[1] | −4.0 | 250 |
| 100 | 200 | 100 | (8) | 100[1] | −4.0 | 150 |
| 100 | 200 | 100 | (5) | 100[1] | −4.5 | 250 |
| 100 | 200 | 100 | (6) | 100[1] | −4.0 | 250 |

[1]Three component mixtures produced a totally cloudy sample with a small denser waxy layer at the bottom whereas the fuel treated with A above had a clean supernatent above the settled wax showing less wax settling using the three component mixture.

EXAMPLE 5

Fuel 2 was treated with A alone and with the mixture of A, B and C. The table shows the advantage of the 3-component mixture over the conventional flow improver (A) in reducing wax settling and improving filterability. The fuel was cooled down to −8° C. (4° C. below its normal Wax Appearance Point of −4° C.) and held at this temperature for 20 hrs. The filterability was tested by the modified CFPP test at −8° C.

| Additive conc. (ppm) | | | Waxy Layer | Wax Appearance Point of bottom | Minimum Mesh |
|---|---|---|---|---|---|
| A | B | C (No.) | (Vol %) | 10% (°C.) | Passed |
| — | — | — | | −4.0 | |
| 400 | — | — | 9 | 5.5 | 60 |
| 600 | — | — | 10 | 7.5 | 60 |
| 200 | 200 | 100 (1) | 100[1] | — | 150 |
| 200 | 200 | 100 (3) | 100[1] | — | 120 |
| 200 | 200 | 100 (4) | 100[1] | −4.0 | 150 |
| 200 | 200 | 100 (7) | 100[1] | — | 120 |
| 200 | 200 | 100 (5) | 100[1] | 3.0 | 250 |
| 200 | 200 | 100 (6) | 100[1] | 3.0 | 150 |

[1]As in the Table of Example 4.

EXAMPLE 6

Comparative tests were made on Fuel 1 using the polar compound C6 to demonstrate the advantages of using the three component mixture rather than combinations of the two of the components.

The fuel samples were cooled at 0.3° C./hour down to −8° C. and held at this temperature for 72 hours and the results are shown in Table 6.

TABLE 6

| Additive conc. (ppm) | | | Waxy Layer | Minimum Mesh |
|---|---|---|---|---|
| A | B | C6 | Vol % | Passed |
| 100 | | | 10 | |
| | 100 | | A Gel formed | |
| | | 100 | A Gel formed | |
| 100 | 100 | | 10 | 20 |
| | 100 | 100 | A Gel formed | |
| 100 | | 100 | 11 | 20 |
| 100 | 200 | 100 | 100[1] | 40 |

[1]As in Table of Example 4.

EXAMPLE 7

In this Example, the fuel used had a cloud point of −3° C., a WAP of −6° C., an initial boiling point of 180° C. and a final boiling point of 365° C. and a CFPP of −7° C. The distillate flow improver used was A and the lube oil pour depressant was B whilst the polar compound C9 was polyisobutylene succinic anhydride, the polyisobutylene chain being of about 1000 molecular weight.

The treated fuel was cooled at 1° C./hour to −11° C., held at −11° C. for 55 hours and then warmed up to 0° C., held at 0° C. for 8 hours, again cooled at 1° C./hour to −11° C. and held at −11° C. for a further 9 hours. A sample of the cold soaked fuel is then sucked through a filter under a pressure of 200 millimeters of water and the minimum mesh through which the material would pass was determined and the results are shown in the following Table 7.

TABLE 7

| Blend | | Minimum Mesh Passed |
|---|---|---|
| 43 | 150 ppm A<br>150 ppm B<br>100 ppm C9 | 85 |
| 44 | 150 ppm A<br>150 ppm B<br>150 ppm C9 | 100 |

EXAMPLE 8

In this Example, the fuel used had a cloud point of +2° C., a wax appearance point of −4° C., an initial boiling point of 185° C. and a final boiling point of 376° C. The CFPP temperature for the untreated fuel was −5° C. The polar compounds were C9, and C10 which was the diamide of the polyisobutylene succinic anhydride C9 of Example 7 and di-normal butyl amine.

The treated fuel was cooled at 1° C./hour to −8° C., held at −8° C. for 30 hours, warmed to +2° C. in 2 hours, held at +2° C. for 5 hours, cooled again to −8° C. at 1° C./hour and held again at −8° C. for a further 10 hours.

20 mls of the bottom 10% of the sample was sucked through a filter under 200 mm of water pressure and the minimum mesh passed is given in the following Table.

| Blend | Additive Conc ppm | Minimum Mesh Passed |
|---|---|---|
| 45 | 150 ppm A<br>150 ppm B<br>75 ppm C9 | 60 |
| 46 | 150 ppm A<br>150 ppm B<br>75 ppm C10 | 250 |

What we claim is:

1. An additive combination for distillate fuel oils, comprising (A) one part by weight of a distillate flow improving composition which is an oil soluble ethylene backbone distillate flow improving polymer having a number average molecular weight in the range of about 500 to 50,000

(B) 0.1 to 10 parts by weight of a lube oil pour depressant which is an oil soluble polymer of monomers other than ethylene, having a molecular weight in the range of about 1000 to 200,000 and wherein at least 10% by weight of said polymer is in the form of straight chain alkyl groups having 6 to 30 carbon atoms, said polymer comprising unsaturated ester, or olefin, monomer moieties, said moieties comprising a major weight proportion of said polymer; and, (C) 0.1 to 10 parts by weight of a polar oil soluble compound different from (A) and (B) and of formula RX, other than an oil soluble nitrogen compound containing about 30 to 300 carbon atoms and having at least one straight chain alkyl segment of 8 to 40 carbon and selected from the class consisting of amine salts and/or amides of hydrocarbyl carboxylic acids or anhydrides having 1 to 4 carboxyl groups where R is an oil solubilizing hydrocarbon group and X is a polar group said compound acting as an anti-agglomerant for wax particles in the fuel oil.

2. An additive combination according to claim 1 in which the distillate flow improving composition is an oil-soluble ethylene backbone distillate flow improving polymer having a number average molecular weight in the range of about 1000 to 6000.

3. An additive combination according to claim 2, wherein the ethylene backbone polymer is selected from the group consisting of branched polyethylene, hydrogenated polybutadiene, chlorinated polyethylene of 10 to 35 wt.% chlorine, and copolymers comprising essentially 3 to 40 molar proportions of ethylene with a molar proportion of a comonomer selected from the group consisting of: $C_3$ to $C_{16}$ alpha monoolefin, vinyl chloride, and ethylenically unsaturated alkyl ester of the formula:

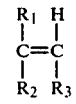

wherein $R_1$ is hydrogen or methyl; $R_2$ is a $—OOCR_4$ or $—COOR_4$ group; $R_4$ is hydrogen or a $C_1$ to $C_{28}$ alkyl group; and $R_3$ is hydrogen or $—COOR_4$ and mixtures of said comonomers.

4. An additive combination according to claim 3 in which the distillate flow improving composition is a copolymer consisting essentially of ethylene and vinyl acetate.

5. An additive combination according to claim 1 wherein said lube oil pour depressant is selected from the group consisting of copolymers of vinyl acetate and dialkyl fumarate, polymers consisting essentially of alkyl methacrylate moities, and esters of polymers of an alpha monoolefin with maleic anhydride.

6. An additive combination according to claim 1 in which the polar compound RX contains from 8 to 150 carbon atoms.

7. An additive combination according to claim 1 in which the polar compound RX is nonionic and contains from 8 to 30 carbon atoms.

8. An additive combination according to claim 6 in which the polar compound RX is ionic containing an ionic end group selected from the group consisting of sulphonate, sulphate, phosphate, phenate including bridged phenate and borate.

9. An additive combination according to claim 6 in which the polar compound RX is an alkyl substituted dicarboxylic acid or anhydride thereof or derivatives thereof.

10. An additive combination according to claim 1 containing one part by weight of the distillate flow improver composition 0.5 to 5 parts by weight of the lube oil pour depressant and 0.5 to 5 parts by weight of the polar oil soluble compound of formula RX.

11. An additive concentrate comprising from 30 to 80 wt.% of a hydrocarbon diluent and from 70 to 20 wt.% of an additive combination according to claim 1.

12. A fuel composition which comprises distillate fuel oil and from 0.001 to 0.5 wt. % of a flow and filterability improving, multicomponent additive composition comprising:

(A) one part by weight of a distillate flow improver composition which is an oil soluble ethylene backbone distillate flow improving polymer having a number average molecular weight in the range of about 500 to 50,000

(B) 0.1 to 10 parts by weight of a lube oil pour depressant which is an oil soluble polymer of monomers other than ethylene, having a molecular weight in the range of about 1000 to 200,000 and wherein at least 10% by weight of said polymer is in the form of straight chain alkyl groups having 6 to 30 carbon atoms, said polymer comprising unsaturated ester, or olefin, monomer moieties, said moieties comprising a major weight proportion of said polymer; and, (C) 0.1 to 10 parts by weight of a polar oil soluble compound different from (A) and (B) and of formula RX where R is an oil solubilizing hydrocarbon group and X is a polar group other than an oil soluble nitrogen compound containing about 30 to 300 carbon atoms and having at least one straight chain alkyl segment of 8 to 40 carbons and selected from the class consisting of amine and/or amides of hydrocarbyl carboxylic acids or anhydrides having 1 to 4 carboxyl groups which acts as an antiagglomerant for wax particles in the oil.

13. A fuel composition according to claim 12 in which the distillate flow improving composition is an oil-soluble ethylene backbone distillate flow improving polymer having a number average molecular weight in the range of about 1000 to 6000.

14. A fuel according to claim 13 wherein the ethylene backbone polymer is selected from the group consisting of branched polyethylene, hydrogenated polybutadiene, chlorinated polyethylene of 10 to 35 wt.% chlorine, and copolymers comprising essentially 3 to 40 molar proportions of ethylene with a molar proportion of a comonomer selected from the group consisting of: $C_3$ to $C_{16}$ alpha monoolefin, vinyl chloride, and ethylenically unsaturated alkyl ester of the formula:

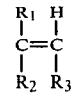

wherein $R_1$ is hydrogen or methyl; $R_2$ is a —$OOCR_4$ or —$COOR_4$ group; $R_4$ is hydrogen or a $C_1$ to $C_{28}$ alkyl group; and $R_3$ is hydrogen or —$COOR_4$, and mixtures of said comonomers.

15. A fuel oil according to claim 12 in which the distillate flow improving composition is a copolymer consisting essentially of ethylene and vinyl acetate.

16. A fuel oil according to claim 12 wherein said lube oil pour depressant is selected from the group consisting of copolymers of vinyl acetate and dialkyl fumarate, polymers consisting essentially of alkyl methacrylate moieties, and esters of polymers of an alpha monoolefin with maleic anhydride.

17. A fuel oil according to claim 12 in which the polar compound RX contains from 8 to 150 carbons atoms.

18. A fuel oil according to claim 12 in which the polar compound RX is nonionic and contains from 8 to 30 carbon atoms.

19. A fuel oil according to claim 17 in which the polar compound RX is ionic containing an ionic end group selected from the group consisting of sulphonate, sulphate, phosphate, phenate including bridged phenate and bornte.

20. A fuel oil according to claim 17 in which the polar compound RX is an alkyl substituted dicarboxylic acid or anhydride thereof or derivatives thereof.

21. An additive combination according to claim 1 wherein said (A) is copolymer consisting essentially of ethylene and vinyl acetate, said (B) is a copolymer of dialkyl fumarate and vinyl acetate, and said (C) is selected from the group consisting of:

1. $C_{24}H_{49}PhSO_4-N+R_4$
2. $C_{24}H_{49}PhSO_4-N+H_2(C_{12}H_{25})_2$
3. $C_9H_{19}PhO-N+H_2(C_{12}H_{25})_2$
4. $C_{17}H_{35}COO-N+H_2(C_{12}H_{25})_2$
5. $CH_3(CH_2)_{15-17}NH_2$
6. $(CH_3(CH_2)_{15-17})_2NH$
7. $C_{18}H_{37}OH$
8. $C_{14}H_{29}OH$.
9. polyisobutylene succinic anhydride wherein said polyisobutylene chain is about 1000 molecular weight, and
10. the di-n-butyl amide of 9, and wherein Ph represents a phenate group.

22. A fuel oil composition according to claim 12, comprising a major amount of distillate fuel oil boiling in the range of 150° to 400° C., and wherein said (A) is copolymer consisting essentially of ethylene and vinyl acetate, said (B) is a copolymer of dialkyl fumarate and vinyl acetate, and said (C) is selected from the group consisting of:

1. $C_{24}H_{49}PhSO_4-N+R_4$
2. $C_{24}H_{49}PhSO_4-N+H_2(C_{12}H_{25})_2$

3. $C_9H_{19}PhO-N^+H_2(C_{12}H_{25})_2$
4. $C_{17}H_{35}COO-N^+H_2(C_{12}H_{25})_2$
5. $CH_3(CH_2)_{15-17}NH_2$
6. $(CH_3(CH_2)_{15-17})_2NH$
7. $C_{18}H_{37}OH$
8. $C_{14}H_{29}OH$.
9. polyisobutylene succinic anhydride wherein said polyisobutylene chain is about 1000 molecular weight, and
10. the di-n-butyl amide of 9, and wherein Ph represents a phenate group.

* * * * *